US006502589B1

(12) United States Patent
Fitzgerald et al.

(10) Patent No.: US 6,502,589 B1
(45) Date of Patent: Jan. 7, 2003

(54) METHOD AND DEVICE FOR CLEANING AND POLISHING JEWELRY

(76) Inventors: Shawn W. Fitzgerald, 7910 Moore Rd., Akron, NY (US) 14001; Jeremy E. Sharkey, 93 Hyde Park, Lockport, NY (US) 14094

( * ) Notice: Subject to any disclaimer, the term of this patent is extended or adjusted under 35 U.S.C. 154(b) by 106 days.

(21) Appl. No.: 09/660,365

(22) Filed: Sep. 12, 2000

(51) Int. Cl.[7] ..... B08B 3/04

(52) U.S. Cl. ..... 134/117; 206/6.1; 220/23.9; 220/495.01; 451/442; 451/457

(58) Field of Search ..... 134/117; 206/6.1, 206/213, 523; 220/23.9, 495.01; 451/442, 457

(56) References Cited

U.S. PATENT DOCUMENTS

| | | | |
|---|---|---|---|
| 2,362,251 | A | 11/1944 | Eggleton |
| 3,167,079 | A | 1/1965 | Weil |
| 3,894,551 | A | 7/1975 | Stohlman |
| 3,904,058 | A | 9/1975 | Rosenstein |
| 4,054,220 | A | 10/1977 | Rosenstein |
| 4,782,941 | A | 11/1988 | Freise |
| 5,000,209 | A | 3/1991 | Mann |
| 5,988,190 | A | 11/1999 | Borges |

FOREIGN PATENT DOCUMENTS

| | | | |
|---|---|---|---|
| CH | 511595 | * 10/1971 | ..... 134/117 |

* cited by examiner

*Primary Examiner*—Philip Coe
(74) *Attorney, Agent, or Firm*—Simpson & Simpson, PLLC

(57) ABSTRACT

The present invention broadly comprises a cleaning device for jewelry comprising a container having a top rim, side walls, and a bottom; a mesh liner operatively arranged to be removably secured within the container and proximate the side walls and bottom; a lid having an outer and inner surface, the lid operatively arranged to be secured to the top rim to seal the container; and, a foam member secured to the inner surface of the lid. The invention also includes a new method of cleaning and polishing jewelry, comprising the steps of immersing the jewelry in liquid cleaning solution contained in a foam-lined sealed container; and, agitating said cleaning solution. An alternative method includes a preliminary step of coating the jewelry to be cleaned with polishing compound prior to immersion.

8 Claims, 6 Drawing Sheets

METHOD AND DEVICE FOR CLEANING AND POLISHING JEWELRY

FIELD OF THE INVENTION

This invention relates generally to jewelry, and, more specifically, to a method and device for cleaning and polishing jewelry.

BACKGROUND OF THE INVENTION

In this patent, the word "jewelry" is meant to comprise rings, bracelets, necklaces, earrings, pendants, chains, pins, ankle bracelets, brooches, gemstones, watches, coins, contact lenses, dentures, ball bearings, screws, nails, washers, nuts, bolts, and the like. In short, the term jewelry in this patent includes all articles within its ordinary meaning, but also includes all articles that have a need to be cleaned and polished. Although jewelry may be made of many different and varied materials, traditionally jewelry has been made of gold, silver, platinum and other precious metals, and often includes precious stones such as diamonds, rubies, emeralds, aquamarines, and the like.

During use, jewelry typically becomes dirty and jewelers and wearers of jewelry alike routinely clean and polish jewelry to restore its original lustre.

Traditionally, individual jewelry pieces have been cleaned by immersing the piece in a dipping basket containing a cleaning solution. The piece is gently soaked for a period of time. The piece is then removed, rinsed with water (preferably warm water) and then dried with a soft cloth. The jewelry may be buffed with a buffing wheel.

A representative prior art device used for cleaning and polishing jewelry is illustrated in FIG. 1. Device 50 generally comprises jar 51 containing liquid cleaning solution 52. The drawing illustrates how the device could be used to clean a piece of jewelry such as ring 21. As shown, ring 21 is secured to hook 32 which is secured to stem 53 which, in turn, extends downwardly from jar lid 54. The lid can be screwed into place atop the jar, and the jar can be gently agitated. Upon removal, the user can further clean the ring with brush 55. Alternatively, for pieces of jewelry that cannot be suspended from hook 32, one can place the jewelry (such as a chain or bracelet, etc.) in basket 57 which includes a porous bottom floor 58.

A problem with prior art devices and methods of cleaning jewelry as shown in FIG. 1 is that the jewelry being cleaned is unprotected against the potentially harmful effects of agitation. The walls of the jar and basket are relatively hard, as is the stem, and agitation can cause the jewelry to collide with these hard surfaces during agitation. The forces associated with agitation vary greatly and depend, in part, upon how much cleaning solution is in the jar, and, of course, upon how hard a person shakes the jar when cleaning. If excessive forces are generated during agitation, there is a possibility that the jewelry will be scratched or damaged, or that precious stones will be dislodged. Moreover, the device shown in FIG. 1 is not effective in polishing jewelry.

What is needed, then, is a new method and device for cleaning and polishing jewelry which provides additional protection for the jewelry being cleaned and polished, provides for agitation of a cleaning solution during cleaning, and is effective in removing polishing compound during cleaning.

SUMMARY OF THE INVENTION

The present invention broadly comprises a cleaning device for jewelry comprising a container having a top rim, side walls, and a bottom; a mesh liner operatively arranged to be removably secured within the container and proximate the side walls and bottom; a lid having an outer and inner surface, the lid operatively arranged to be secured to the top rim to seal the container; and, a foam member secured to the inner surface of the lid. The invention also includes a new method of cleaning and polishing jewelry, comprising the steps of immersing the jewelry in liquid cleaning solution contained in a foam-lined sealed container; and, agitating said cleaning solution. An alternative method includes a preliminary step of coating the jewelry to be cleaned with polishing compound prior to immersion.

A general object of the invention is to provide a new method and device for cleaning and polishing jewelry.

A secondary object of the invention is to provide a new method of cleaning and polishing jewelry that enables more vigorous agitation of the jewelry in a cleaning solution than prior art methods while simultaneously providing more protection for the jewelry being cleaned.

These and other objects, advantages and features of the present invention will become readily apparent to those having ordinary skill in the art from a reading of the following detailed description of the invention in view of the drawings and appended claims.

DETAILED DESCRIPTION OF THE PREFERRED EMBODIMENT

At the outset, it should be appreciated that like drawing numbers on different drawing views identify identical structural elements of the invention.

While the present invention has been described with respect to what is presently considered to be the preferred embodiments, it is understood that the invention is not limited to the disclosed embodiments. The present invention is intended to cover various modifications and equivalent arrangements included within the spirit and scope of the appended claims.

Figure 1:
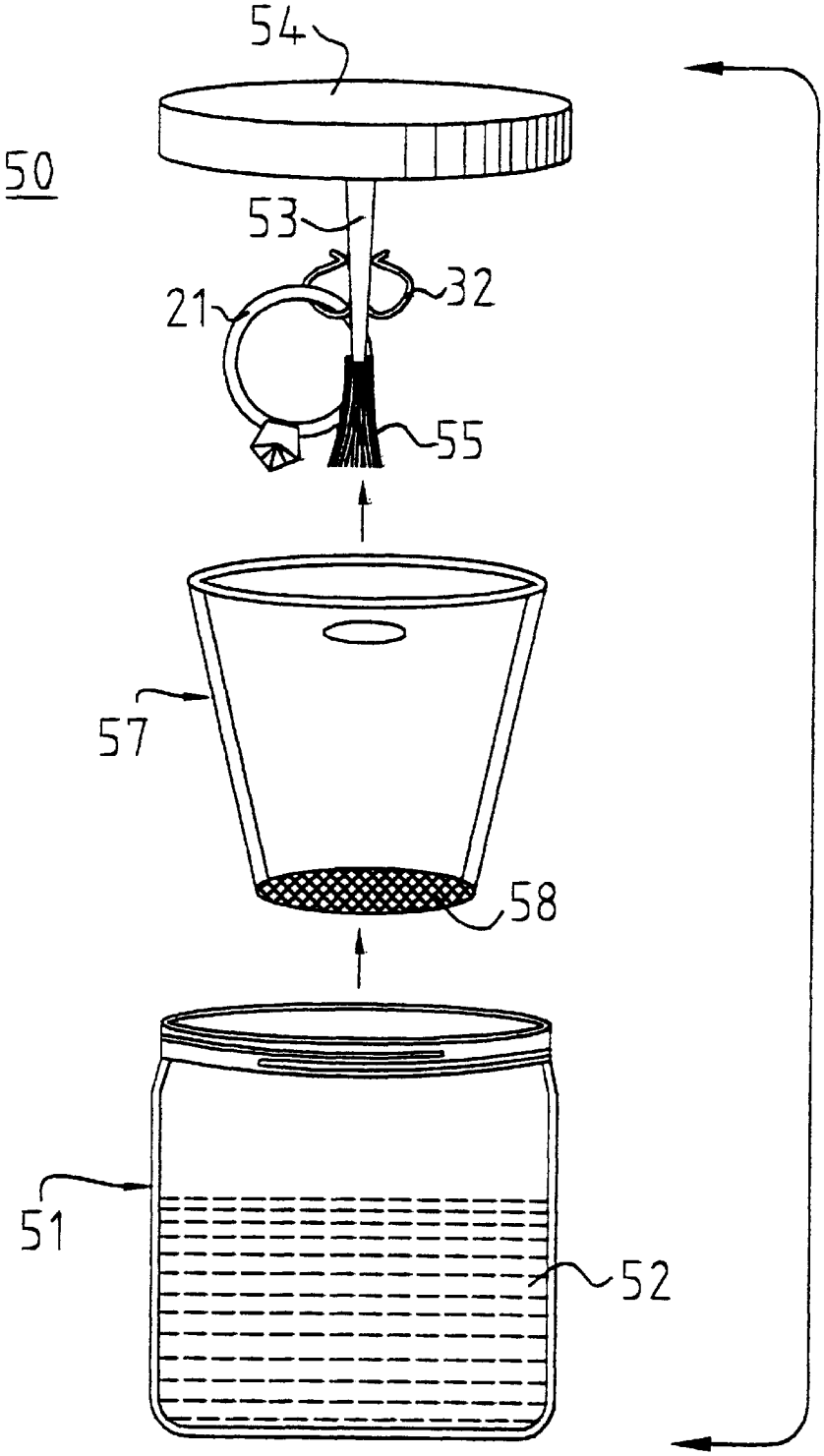
FIG. 1 PRIOR ART
FIG. 1 is an exploded view of a representative prior art device for cleaning jewelry.
Figure 2:
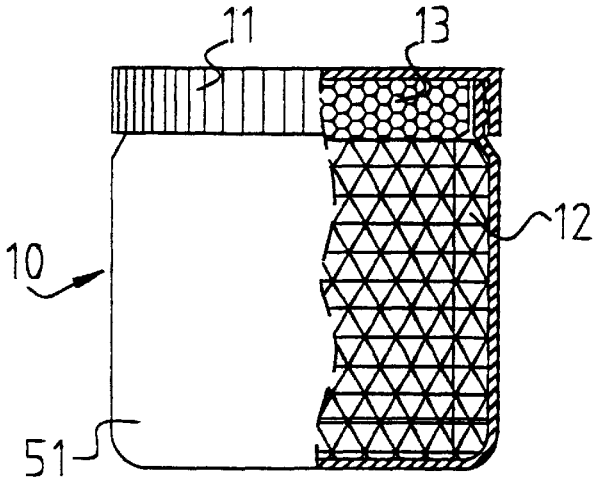
FIG. 2 is a side elevation, partially sectioned, of the container of the present invention.

Adverting again to the drawings, jewelry cleaning container 10 is shown in side elevation, partially sectioned, in FIG. 2. Container 10 includes jar 51 which may be made of plastic, glass or any other suitable material. The container also includes lid 11 which is threadably securable to the jar. The lid also may be made of plastic, glass, or any other suitable material.

Figure 3:
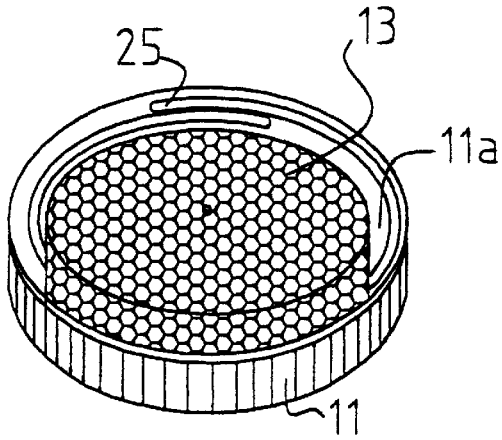
FIG. 3 is a perspective view of the lid for the container shown in FIG. 2.

As shown in FIG. 3, foam member 13 is fixedly secured to inner surface 11*a* of lid 11. Foam member 13 is preferably circular in shape, although it is not critical that it be circular in shape. In a preferred embodiment, foam member 13 is comprised of polyethylene foam. This foam is commercially available from a number of manufacturers and distributors, including Foamex International Inc. of Arcade, N.Y., and TMP Technologies, Inc. of Buffalo, N.Y. Other types of foam may also be used.

Figure 4:
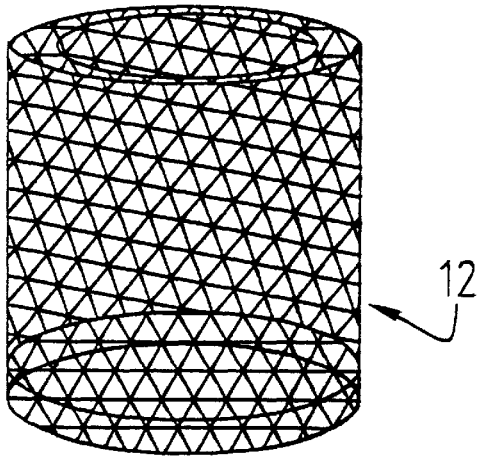
FIG. 4 is a perspective view of mesh liner 12 of the invention.

As shown in FIG. 4, container 10 also includes mesh liner 12. In a preferred embodiment, mesh liner 12 comprises polyurethane, although the liner could be made from other suitable materials. In an alternative preferred embodiment, the mesh liner comprises plastic foam. In a most preferred embodiment, the mesh liner is polyurethane foam. The polyurethane liner material of the invention is commercially available from a number of manufacturers and distributors, including Foamex International Inc. of Arcade, N.Y., and TMP Technologies, Inc. of Buffalo, N.Y. In one embodiment of the invention, shown in FIGS. 2, 4 and 5, mesh liner 12 actually comprises cylindrical member 12*a* and circular member 12*b*. In a second embodiment shown in FIG. 6, mesh liner 12 comprises a single piece having a cylindrical wall section 12*c* and a bottom round section 12*d*, where the cylindrical wall section and bottom round section are integral. In either embodiment, the mesh liner may be fabricated from polyurethane foam.

Figure 5:
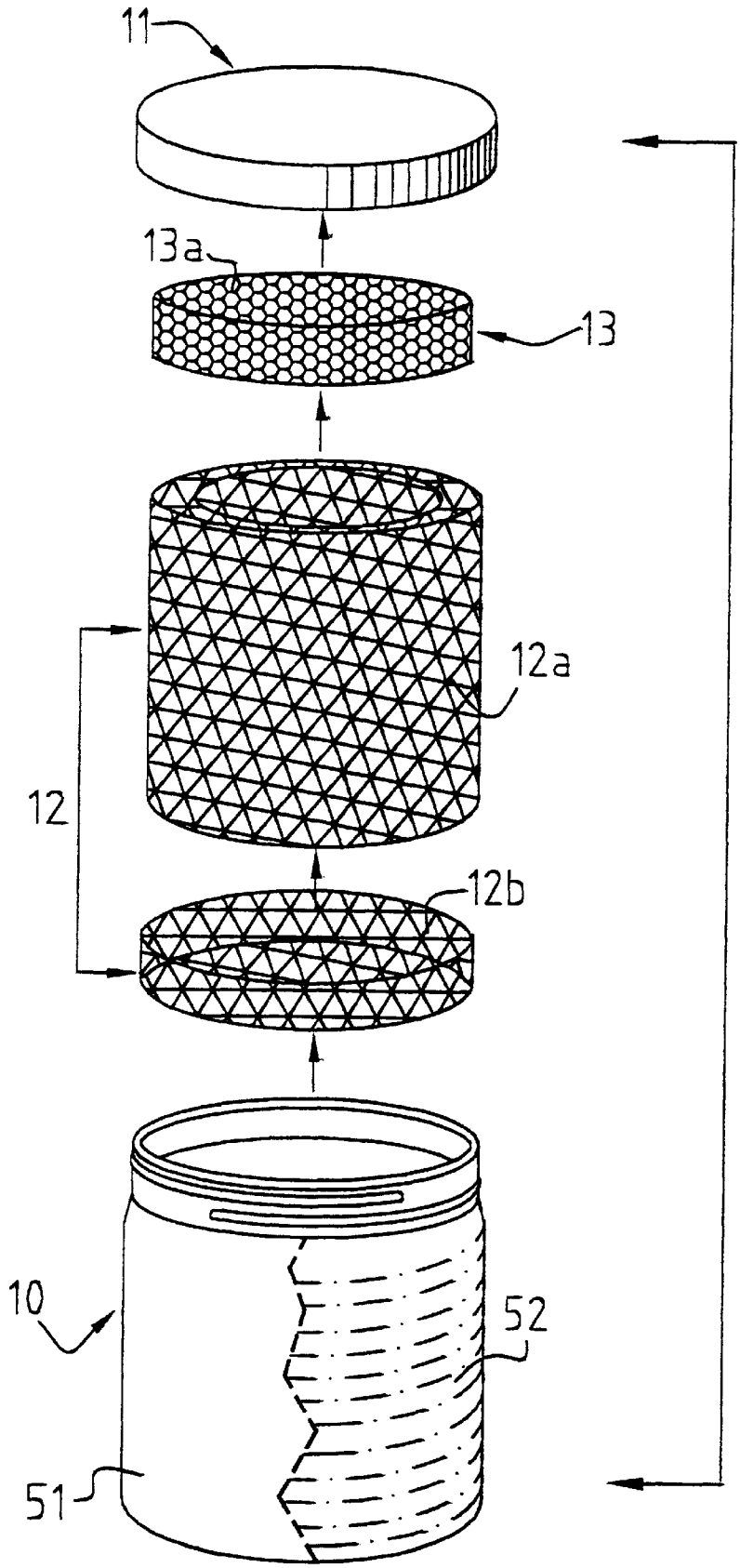
FIG. 5 is an exploded view of the container of the invention.

The container of the invention is shown in exploded view in FIG. 5. As shown in this view, circular mesh liner member 12*b* lies on the floor of jar 51. Cylindrical mesh liner member 12*a* rests atop member 12*b* and is positioned proximate the inner surface of the cylindrical wall of jar 51. Circular foam member 13 is fixedly secured to lid 11 such that upper surface 13*a* is secured to lower surface 11*a* (shown in FIG. 3) of lid 11. As shown in partial cross-section in FIG. 2, foam member 13 is positioned proximate mesh liner 12 when lid 11 is secured to jar 51. Thus, it is seen that foam member 13 and mesh liner 12 function to define and completely surround a cavity within the jar. When the jar is filled with cleaning solution, the foam member and mesh liner function together to protect the jewelry being cleaned during agitation, cleaning and polishing. Moreover, the structure of the foam member and mesh liner provide maximum surface area to increase the effectiveness of agitation of the cleaning solution.

Figure 6:
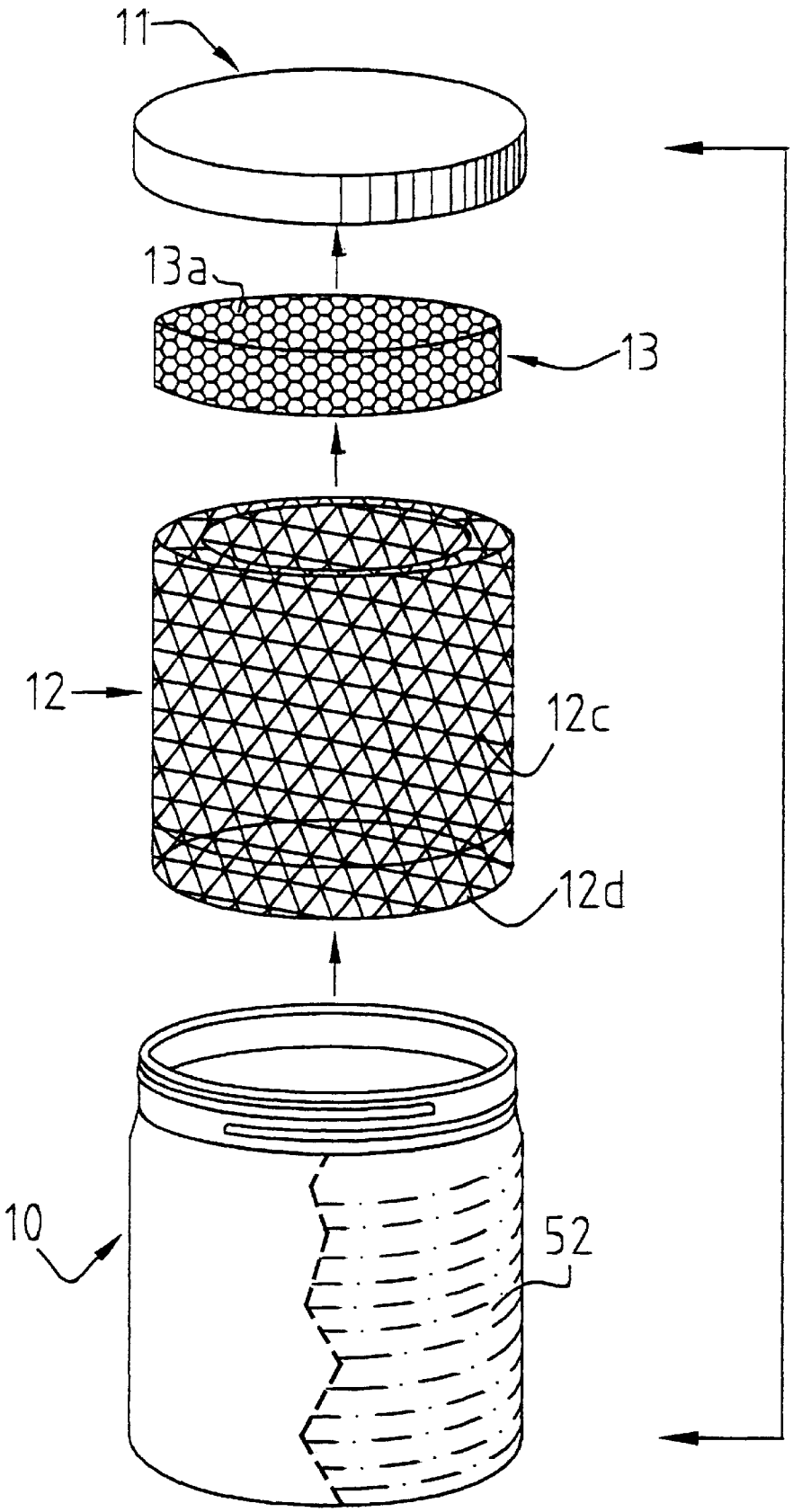
FIG. 6 is a view similar to that of FIG. 5 but showing mesh liner 12*c* as a single piece.

A second embodiment of the cleaning container of the invention is shown in FIG. 6. In this embodiment, container 10 is identical to that shown in FIG. 5, except that mesh liner 12 is a unitary piece comprising cylindrical wall section 12*c* secured to circular floor section 12*d*. It should be appreciated that the shape of the foam and mesh liner members of the invention is not critical, so long as they together form a protected cavity within the jar.

Figure 7:
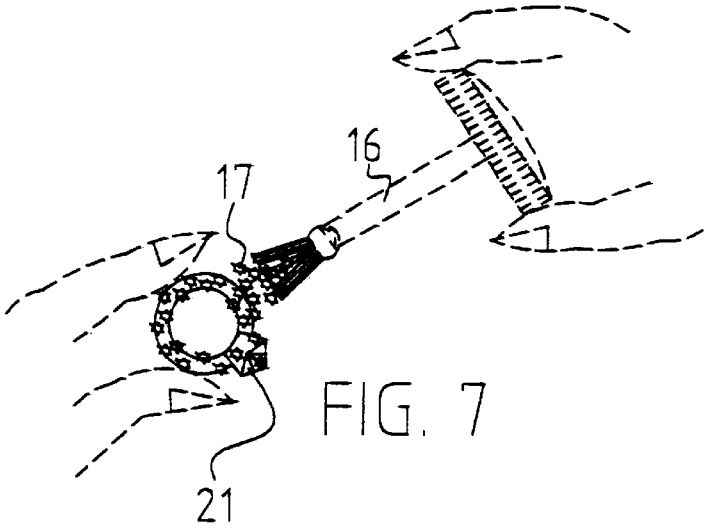
FIG. 7 is a view illustrating application of polishing compound to a piece of jewelry.

The method of the invention is best understood with reference to FIGS. 7–11. A first optional step in the method is to coat a piece of jewelry (such as ring 21) with a polishing compound 17 (sometimes referred to in the art as "jeweler's rouge". Examples of suitable polishing compounds include Simichrome Polish, imported by Competition Chemicals of Iowa Falls, Iowa and distributed by Gesswein Distributing of Bridgeport, Conn.; and Flitz Silver Polish imported by Grobet USA of Carlstadt, N.J. and distributed by Gaber & Company of Pittsburg, Pa. The polishing compound may be applied by brush as shown in FIG. 7, or with a cloth or even by hand.

Figure 8:
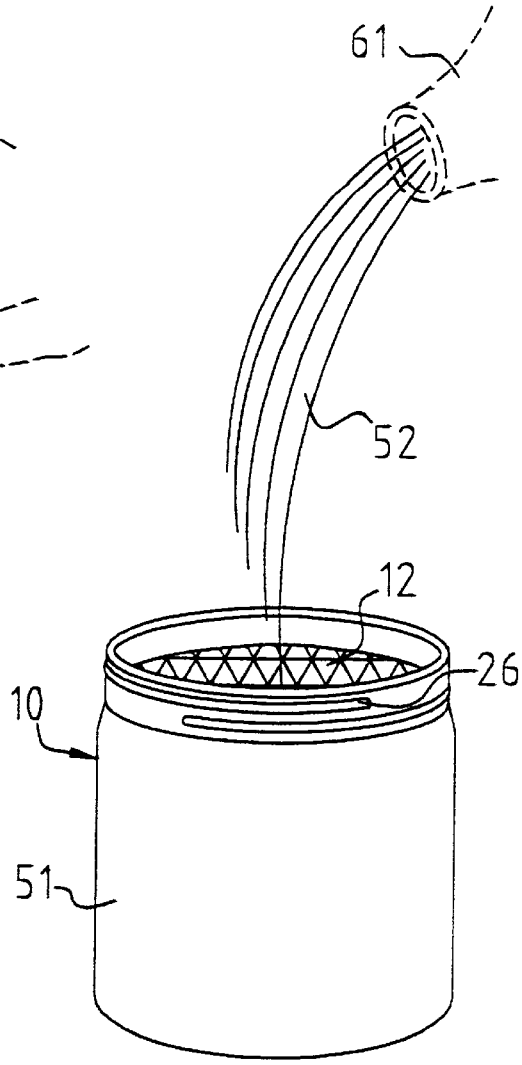
FIG. 8 is a perspective view illustrating jewelry cleaning solution being added to the container of the invention.

Cleaning solution 52 is added to mesh and foam-lined jar 51 as shown in FIG. 8 to enable the next step in the cleaning method. Solution 52 typically comprises ammonia, water and surfactant. One suitable commercial liquid cleaning solution is available from Reflective Solutions, Inc., 51 Main Street, Lockport, N.Y.

Figure 9:
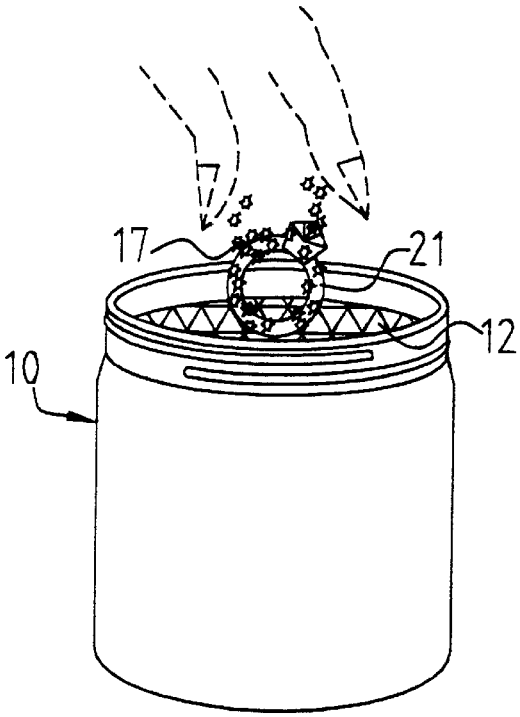
FIG. 9 illustrates the step of immersing a piece of jewelry in the cleaning solution contained in the container of the invention.
Figure 10:
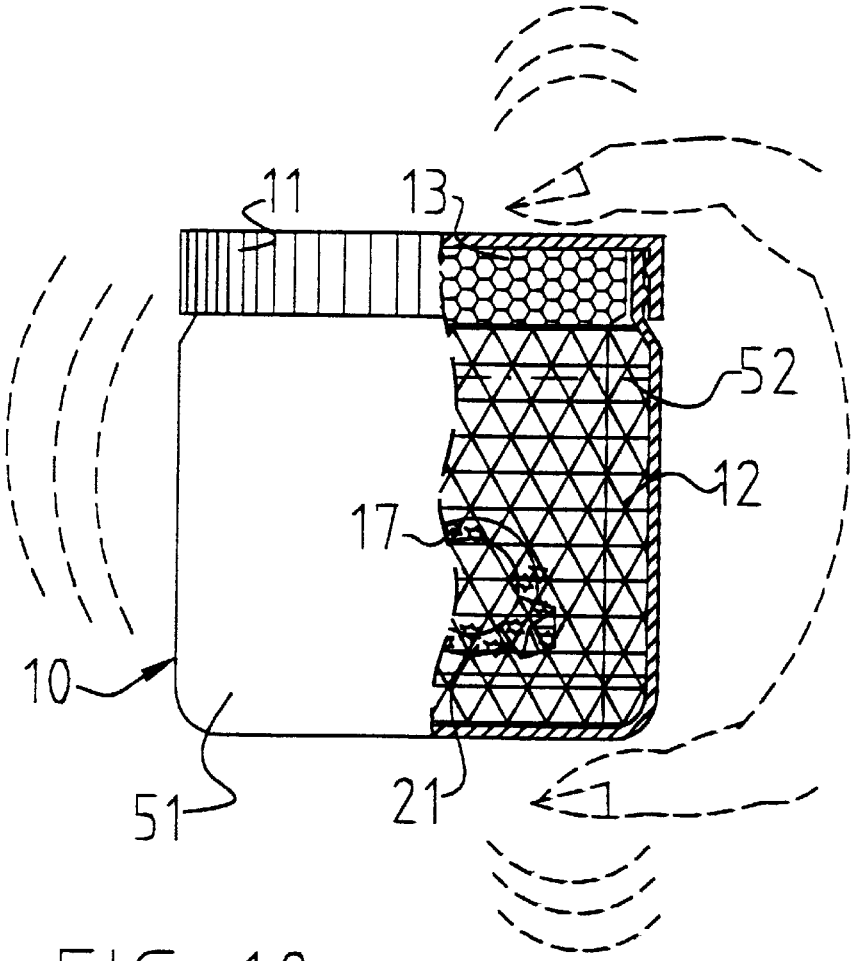
FIG. 10 illustrates the step of agitation of a piece of jewelry in the container of the invention; and, FIG. 11 illustrates a piece of jewelry cleaned and polished by the method and apparatus of the present invention.
Figure 11:
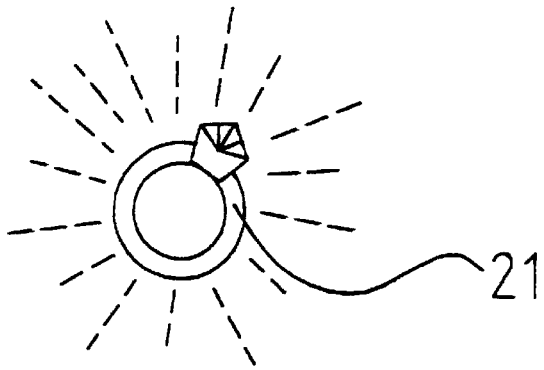

The next step in the cleaning method is to immerse ring 17 in the cleaning solution as shown in FIG. 9. Lid 11 is then threadably secured to jar 51 as shown in FIG. 10 (thread 25 of lid 11 as shown in FIG. 3 engages thread 26 of jar 51 shown in FIG. 8) and the jar is agitated by hand, also as shown in FIG. 10. It should be appreciated that ring 17 is completely protected during agitation by mesh liner 12 and foam member 13. Agitation of the ring in the cleaning solution tends to remove the polishing compound and clean and polish the ring. The cleaned and polished ring 21 is shown in FIG. 11.

Thus it is seen that the objects of the invention are efficiently obtained, although changes and modifications to the invention should be readily apparent to those having ordinary skill in the art, which changes would not depart from the spirit and scope of the invention as claimed.

What is claimed is:

1. A cleaning device for jewelry comprising:

a container having a top rim, side walls, and a bottom;

a mesh liner operatively arranged to be removably secured within said container and proximate said side walls and bottom;

a lid having an outer and inner surface, said lid operatively arranged to be secured to said top rim to seal said container; and, a foam member secured to said inner surface of said lid such that said foam member is proximate said mesh liner when said lid is secured to said container to thus define a cavity within said container.

2. A cleaning device for jewelry as recited in claim 1 wherein said mesh liner comprises polyurethane.

3. A cleaning device for jewelry as recited in claim 1 wherein said foam member comprises polyethylene.

4. A cleaning device as recited in claim 1 wherein said mesh liner comprises a single, unitary liner of polyurethane foam.

5. A cleaning device as recited in claim 1 wherein said mesh liner comprises cylindrically shaped foam member operatively arranged to line said side walls and a circularly shaped foam member operatively arranged to line said bottom.

6. A cleaning device as recited in claim 5 wherein said mesh liner comprises cylindrically shaped polyurethane foam member operatively arranged to line said side walls and a circularly shaped polyurethane foam member operatively arranged to line said bottom.

7. A cleaning device as recited in claim 1 further comprising a liquid cleaning solution within said container, said solution comprising ammonia, water and surfactant.

8. A cleaning device as recited in claim 1 wherein said jewelry is selected from the group consisting of rings, bracelets, necklaces, earrings, pendants, chains, pins, ankle bracelets, brooches, gemstones, watches, coins, contact lenses, dentures, ball bearings, screws, nails, washers, nuts and bolts.

* * * * *